US007918628B1

(12) United States Patent
Siver et al.

(10) Patent No.: US 7,918,628 B1
(45) Date of Patent: Apr. 5, 2011

(54) LANDSCAPING BLOCKS FOR FORMING RETAINING WALLS AND METHOD OF PRODUCING LANDSCAPING BLOCKS

(76) Inventors: Mark A. Siver, Wake Forest, NC (US); Wayne P. Siver, Wake Forest, NC (US); Jeffery L. Hansen, Wake Forest, NC (US)

( * ) Notice: Subject to any disclaimer, the term of this patent is extended or adjusted under 35 U.S.C. 154(b) by 1372 days.

(21) Appl. No.: 10/946,428

(22) Filed: Sep. 21, 2004

(51) Int. Cl.
*E02D 29/02* (2006.01)

(52) U.S. Cl. ..... 405/286; 52/604

(58) Field of Classification Search ..... 52/604, 52/606, 608, 612; 405/262, 284, 286; 404/34; D25/113, 114
See application file for complete search history.

(56) References Cited

U.S. PATENT DOCUMENTS

| | | | | | |
|---|---|---|---|---|---|
| 1,795,451 | A | * | 3/1931 | Sharpe | 52/314 |
| 1,909,539 | A | * | 5/1933 | Huntoon | 405/273 |
| 2,313,363 | A | * | 3/1943 | Schmitt | 405/286 |
| 2,882,689 | A | * | 4/1959 | Huch et al. | 405/284 |
| 4,831,802 | A | * | 5/1989 | Cromrich et al. | 52/606 |
| 5,294,216 | A | * | 3/1994 | Sievert | 405/286 |

FOREIGN PATENT DOCUMENTS

| | | | |
|---|---|---|---|
| JP | 62-264219 | * | 11/1987 |
| JP | 63-142125 | * | 6/1988 |
| JP | 6-57767 | * | 3/1994 |
| JP | 6-93626 | * | 4/1994 |
| JP | 6-108483 | * | 4/1994 |
| JP | 6-207417 | * | 7/1994 |
| JP | 6-287968 | * | 10/1994 |

* cited by examiner

*Primary Examiner* — Sunil Singh
(74) *Attorney, Agent, or Firm* — Coats & Bennett, P.L.L.C.

(57) ABSTRACT

A set of landscaping blocks is provided for building a retaining wall. The set of landscaping blocks include three groups of precast blocks with each group being of a different size and particularly having a different depth. The group of blocks having the greatest depth is utilized to form one or more lower courses of the retaining wall. The group of blocks having the second greatest depth is utilized to form one or more intermediate courses for the retaining wall, and the intermediate courses of block are stacked over the one or more lower courses of block. Finally, the group of blocks having the least depth is utilized to form one or more upper courses of the retaining wall. Once the retaining wall is formed, a backside of the retaining wall assumes a step configuration wherein portions of the upper surfaces of the lower and intermediate courses are exposed. To form the blocks of each group, concrete is poured into a mold having a series of side-by-side sections. Disposed in each section of the mold is a molded surface having a stone design formed therein. Thus, at least one face of each block formed in each section of the mold includes a molded face that conforms to the design of the molded surface.

34 Claims, 8 Drawing Sheets

LANDSCAPING BLOCKS FOR FORMING RETAINING WALLS AND METHOD OF PRODUCING LANDSCAPING BLOCKS

FIELD OF THE INVENTION

The present invention relates to precast landscaping blocks, and more particularly to precast concrete blocks that include a molded face that simulates natural stone and which can be dry stacked one on top of the other to form a retaining wall.

BACKGROUND OF THE INVENTION

Natural stones are used in landscaping residential and commercial buildings. For example, natural stone can be utilized to form planters, retaining walls, curbing or edging. There are, however, a number of drawbacks and disadvantages to natural stone. First, natural stone must be mined, packaged and transported. Often to obtain certain types of stone, the natural stone must be transported long distances. Thus there are substantial expenses involved in mining natural stone, handling the stone and transporting the stone sometimes as far as country to country.

In addition, laying natural stone is time consuming and expensive. This is because natural stone is not uniform in shape and size. Natural stone is difficult to lay in a mortar base and even more difficult to lie in a dry stack. Further compounding the problem is that skilled stone laying tradesmen are difficult to find and when they are located, they too are expensive.

Because of the expense of natural stone and the difficulties encountered in laying, a market has developed for unnatural landscaping blocks that include a front face that simulate stone, brick or other more traditional landscaping structures. For the most part, these unnatural stone products are of one size or depth. When these stones are utilized to form a retaining wall, for example, in many cases some form of a mechanical tie or support must be incorporated into the wall structure in order to meet code requirements or to meet fundamental engineering standards. Often these mechanical ties or mechanical support structures include a plastic, fiberglass, metal or nylon webbing that is secured between spaced courses of block and extend therefrom where the webbing ties into a backfill material or to a structure or the ground that lies behind the retaining wall. Again, this is expensive and time consuming.

Therefore, there has been and continues to be a need for a landscaping block set that is of a precast type which can be utilized to build a retaining wall without requiring the retaining wall to be mechanically tied or supported to a structure or to the backfill or ground material lying behind the retaining wall.

SUMMARY OF THE INVENTION

The present invention provides a landscaping block set used for forming a retaining wall. In one embodiment of the present invention the block set includes at least two groups of precast landscaping blocks. One group of the landscaping blocks includes a depth greater than the depth of the other group. When forming the retaining wall, the group of precast landscaping blocks having the greatest depth is utilized to form one or more lower courses of the retaining wall. Stacked on top of the one or more lower courses of the retaining wall is the second group of precast landscaping blocks that include a depth less than the depth of the landscaping blocks that form one or more of the lower courses. Thus, when the upper most course or courses of landscaping blocks are disposed over preceding courses, it follows that a portion of the upper surfaces of the one or more lower courses are exposed. This gives rise to a step configuration formed about the backside of the retaining wall.

In one particular embodiment, the set of landscaping blocks includes first, second and third groups of precast landscaping blocks. The first group of blocks includes a depth greater than the depth of the second group of blocks while the second group of blocks includes a depth greater than the depth of the third group of blocks. Thus, the first group of blocks forms one or more lower courses of the retaining wall. The second group of blocks forms one or more intermediate courses of the retaining wall. Finally, the third group of blocks forms one or more upper courses of the retaining wall. Together the three groups of precast block form a step configuration about a rear side of the retaining wall.

Another aspect of the present invention entails forming a retaining wall from a set of precast landscaping blocks. This method entails selecting from the set a first group of landscaping blocks having a depth and utilizing the first group of blocks to form one or more lower courses of the retaining wall. Next the method entails selecting from the set a second group of landscaping blocks having a depth less than the depth of the first group of blocks and forming one or more intermediate courses of the retaining wall with the second group of blocks by stacking the second group of blocks over the first group of blocks. The method also entails selecting from the set a third group of landscaping blocks having a depth less than the depth of the blocks of the second group. The blocks of the third group are stacked above the blocks of the second group. Because the depth of the blocks of the various groups vary, and the blocks with the greatest depth are laid in the lower or lower most courses while the blocks having the intermediate depth are laid in the intermediate courses, and the blocks having the smallest depth are laid in one or more upper courses, it follows that a retaining wall is formed where the backside of the retaining wall assumes a step configuration.

Another embodiment of the present invention entails a method of forming precast landscaping blocks by extending an elongated member through the walls of a plurality of sections disposed in side-by-side relationship that form a part of a mold. To form a design in a face portion of each block, a molded design is disposed in the bottom of each section. Next the method entails pouring concrete into the plurality of sections such that the concrete in each section is supported over the molded design. The molded design disposed in the bottom of each section molds a corresponding design in a face of the concrete block formed in each section of the mold.

Other objects and advantages of the present invention will become apparent and obvious from a study of the following description and the accompanying drawings, which are merely illustrative of such invention.

DESCRIPTION OF THE INVENTION

Figure 1:
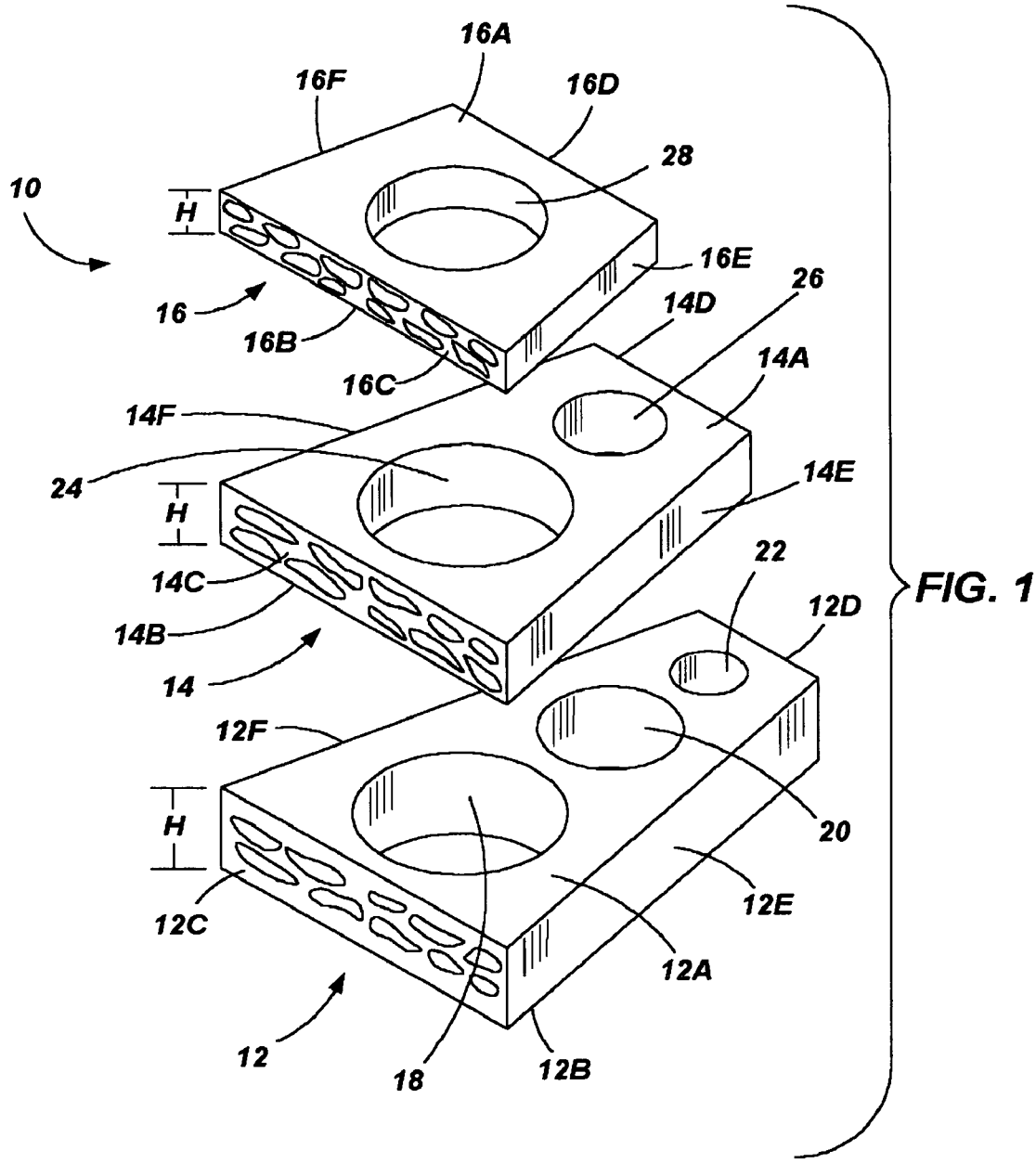
FIG. 1 is a perspective view of a set of precast landscaping blocks according to the present invention.
Figure 2:
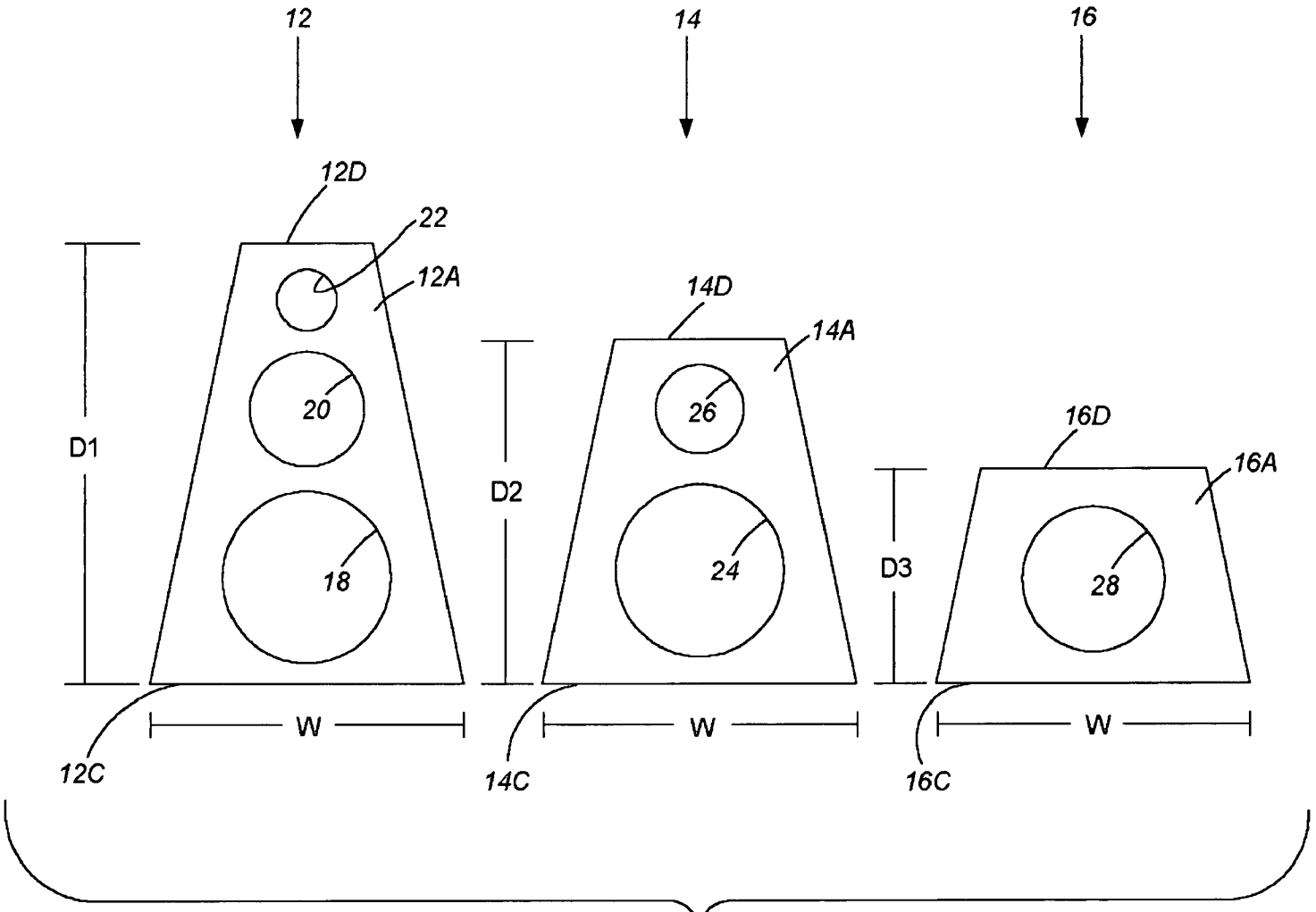
FIG. 2 is a top plan view of the set of blocks shown in FIG. 1.

With further reference to the drawings, particularly FIGS. 1-4, the present invention is shown therein and comprises a set of precast concrete landscaping blocks. The set of landscaping blocks is referred to generally by the numeral 10. In the case of one embodiment, the set of precast concrete landscaping blocks 10 comprises a first group of blocks 12, a second group of blocks 14, and a third group of blocks 16. As seen in FIGS. 1 and 2, the three groups of blocks 12, 14, and 16 are of a different size. More particularly, each block of each group includes a depth. The depth of the blocks of the first group is referred to as D1, the depth of the blocks of the second group 14 is referred to as D2, and the depth of the third group of blocks 16 is referred to as D3. Further, each block includes a width W and a height H. In some embodiments, the height of the blocks can vary. In one set of blocks, the height of the individual blocks could be 3 inches, 4½ inches, and/or 6 inches.

Each group of blocks would include a plurality of like blocks. That is, for example, the depth of the blocks constituting the first group 12 would be equal and the same would apply for the depth of the second and third groups 14 and 16. However, it may be advantageous to vary the width of blocks in each group. That is, some blocks in the respective groups may be of a different width or even a different height. As seen in FIGS. 1 and 2, the depth of the blocks 12, 14 and 16 varies. Blocks of group 12 include a depth D1 that exceeds the depth D2 of the second group of blocks 14. Similarly, the depth D2 of the second group of blocks 14 exceeds the depth D3 of the third group of blocks.

Viewing the structure of the blocks of the first group 12, it is seen that these blocks include an upper surface 12A and a lower surface 12B. These surfaces are generally flat. Further, blocks of the first group 12 include a face or front 12C. As will be appreciated from subsequent portions of the disclosure, the face 12C is molded to simulate the appearance of a natural stone, for example. Other designs can be molded into the face 12C. Disposed opposite face 12C is a back 12D. Note that due to the tapered construction of the blocks, the width of the back 12D is less than the width of the face 12C. Finally, each block of the first group 12 includes a pair of sides 12E and 12F. Sides 12E and 12F are straight, but extend in non-parallel relationship. That is, the width of the blocks becomes progressively narrow from the face 12C to the back 12D.

The description of the structure of the blocks of the first group 12 applies to the blocks of the second and third groups 14 and 16. That is, blocks of the second and third groups include an upper face 14A, 16A, a lower surface 14B, 16B, etc.

As noted above, each block is of a precast construction. In the embodiment illustrated herein it is contemplated that one material utilized to form the blocks is concrete.

Each of the blocks that form the set 10 includes one or more openings that extend from the upper surface to the lower surface. In the case of the blocks of the first group 12, each of these blocks includes a series of openings 18, 20 and 22. These openings are aligned and become progressively smaller from the face 12C to the back 12D. Likewise blocks of the second group 14 include a pair of openings 24 and 26. Openings 24 and 26 are generally aligned with opening 24 adjacent the face 14C having a larger diameter than the opening 26 formed adjacent the back 14D. Finally, the blocks of the third group 16 include a single round of circular openings 28.

The set of blocks 10 can be utilized to form a dry stacked retaining wall 30. See FIGS. 3 and 4. Generally the group of blocks having the greatest depth would form one or more of the lower courses of the retaining wall 30. After the one or more lower courses have been laid, one or more intermediate courses are laid over the one or more lower courses. In this case, the blocks constituting the intermediate course or courses would have a depth less than the depth of the blocks constituting the one or more lower courses previously laid. When laying the intermediate courses, the faces of the intermediate course or courses would be aligned with the faces of the one or more lower courses. This means that the back 14D of the blocks of the one or more intermediate courses would terminate short of the back 12D of the one or more lower courses. Further, it follows that a portion of the upper surfaces 12A of the uppermost lower course would be exposed. In the case of the embodiment shown in FIGS. 3 and 4, the retaining wall 30 includes one or more upper courses made up of blocks having a depth less than the depth of the intermediate course or courses. Thus, it is appreciated that the backside of the retaining wall 30 would form a step configuration as viewed in FIG. 4.

Figure 3:
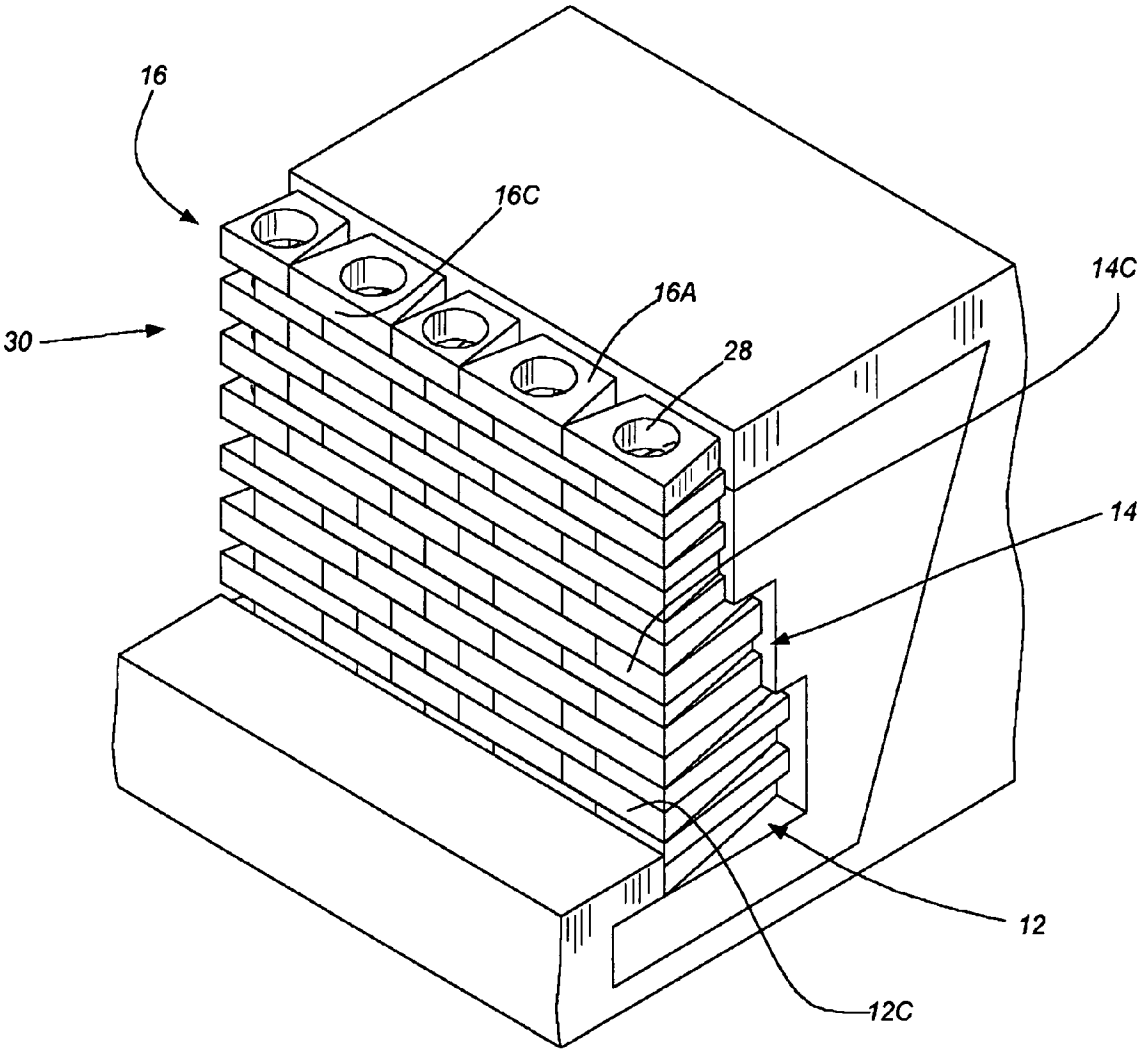
FIG. 3 is a fragmentary perspective view showing a retaining wall constructed from the landscaping blocks of the present invention.
Figure 4:
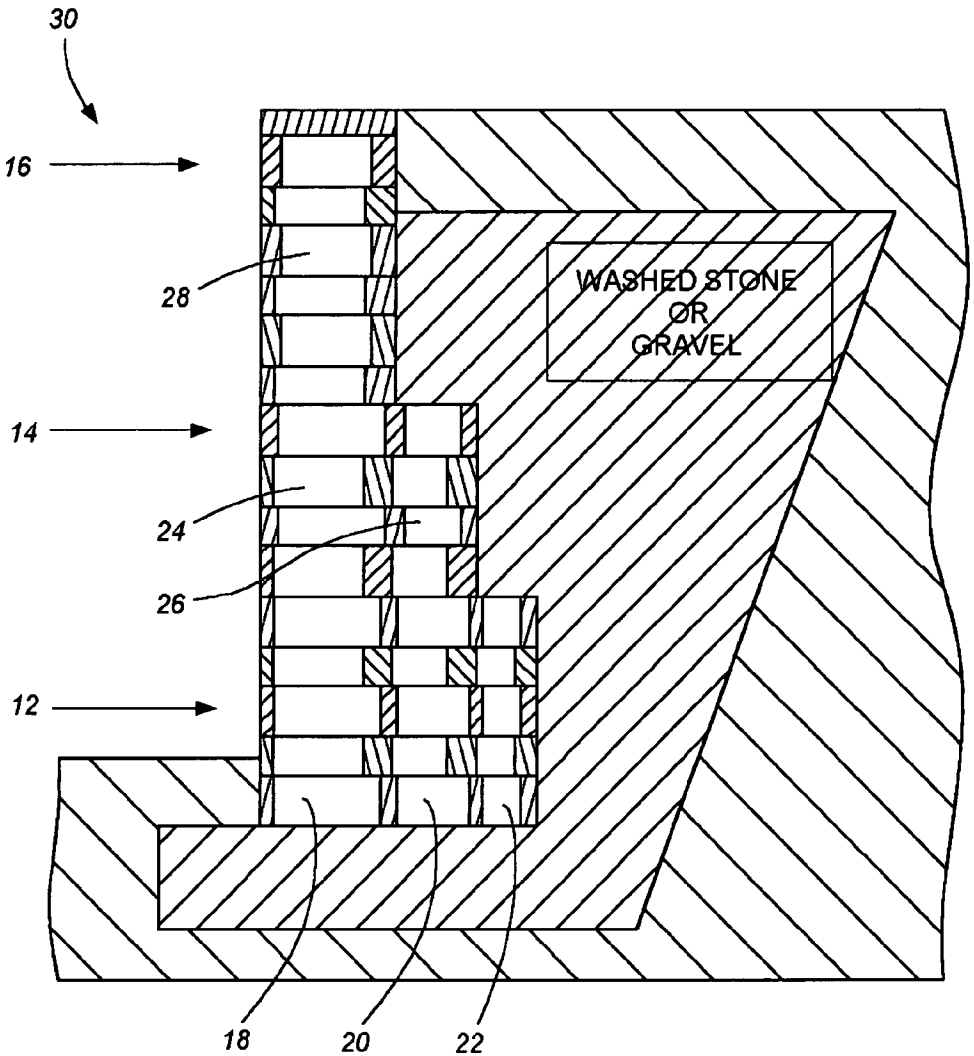
FIG. 4 is a cross sectional view of the retaining wall shown in FIG. 3.

In the case of one embodiment where the set of precast landscape blocks 10 comprises three groups, 12, 14 and 16, the retaining wall 30 would form the structure shown in FIGS. 3 and 4. Here the first group of blocks 12 forms a series of lower courses. Second group of blocks 14 forms another series of intermediate courses that are disposed and supported over the blocks of the first group 12. Finally, another series of upper courses is provided by blocks of the third group 16. Note that the backs 12D, 14D and 16D of the respective blocks do not align, but are offset with respect to each other to form the step configuration shown in FIG. 4. In the case of this embodiment, all of the blocks of the first and second groups 12 and 14 as well as all of the blocks of the third group except the uppermost course, include openings 18, 20, 22, 24, 26 and 28. These openings are filled with washed stone or gravel. The uppermost course made up of blocks of the third group 16 would be solid and would not include the openings 28. In one embodiment, the respective blocks would be dry stacked. However, the upper or top course would preferably be secured by adhesive or other means to the underlying course.

Note that the retaining wall 30 shown in FIGS. 3 and 4 is supported on a washed stone or washed gravel structure. Note further that the washed stone or washed gravel also forms the backfill for the retaining wall 30. As discussed above, washed stone or gravel is poured into the openings of the respective blocks. Further, because of the tapered construction of the individual blocks, there will be opening gaps formed between the respective blocks especially about the back portion of the retaining wall 30. Washed gravel or stone would also fill these areas. The retaining wall 30 shown in FIGS. 3 and 4 may be of a height of approximately 7 feet. It is believed that the set of blocks 10 disclosed herein is useful in forming and constructing retaining walls having a height of approximately 4 to 7 feet. Blocks of the set 10 can also be utilized to form walls less than 4 feet.

In the case of the retaining wall 30 shown in FIGS. 3 and 4, the respective blocks that from the various groups can be dry stacked such that the faces 12C, 14C and 16C are generally aligned. Retaining wall 30 can be constructed without a tie or a mechanical support extending from the retaining wall 30 rearwardly into the backfill or the adjacent exposed ground. Because of the tapered construction of the individual blocks, it follows that curved or arcuate shaped retaining walls can be constructed with the block.

Figure 5:
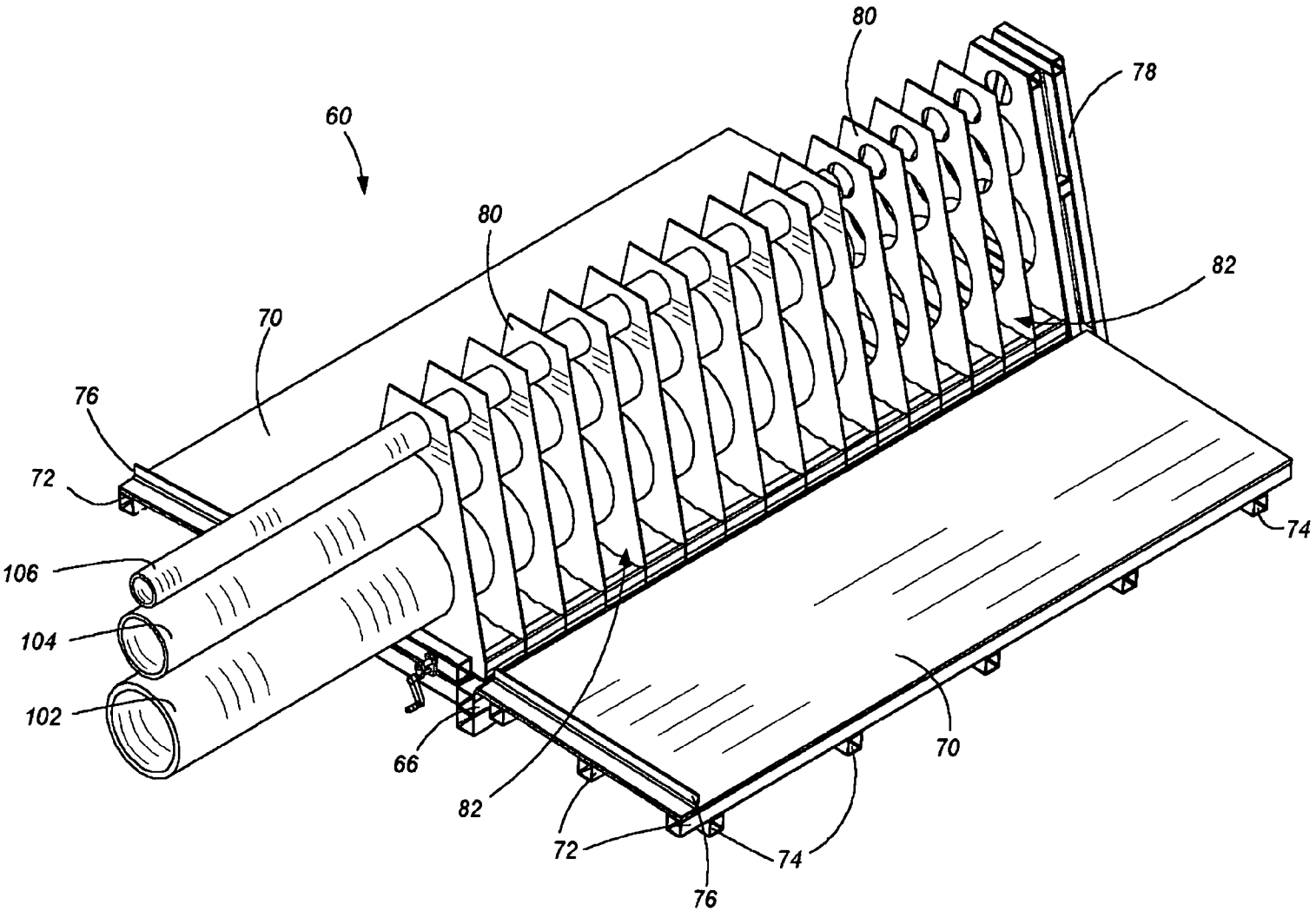
FIG. 5 is a perspective view of a mold, shown in an open position, for casting the landscaping blocks of the present invention.
Figure 6:
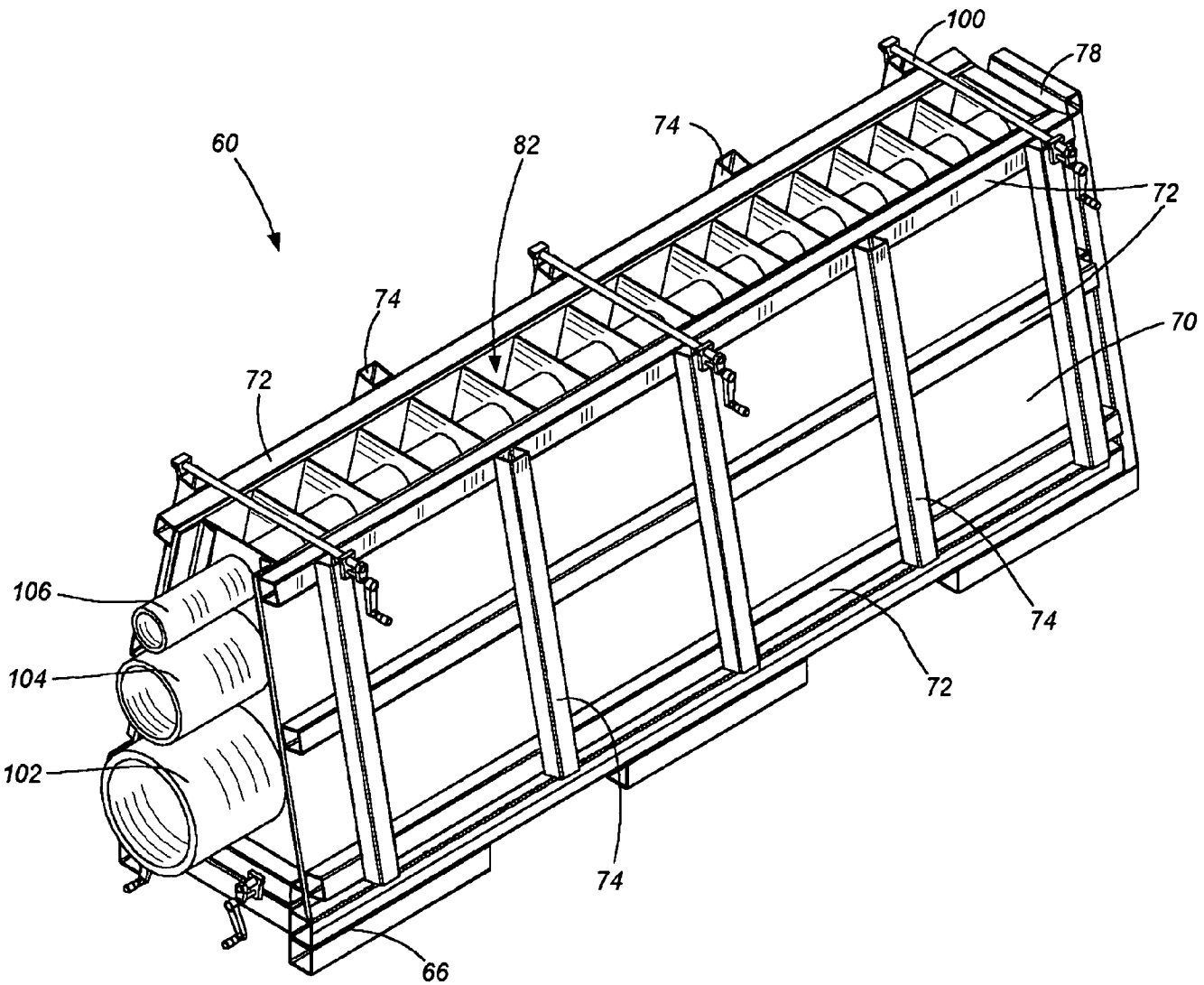
FIG. 6 is a perspective view of the mold shown in FIG. 5 in a closed position.
Figure 7:
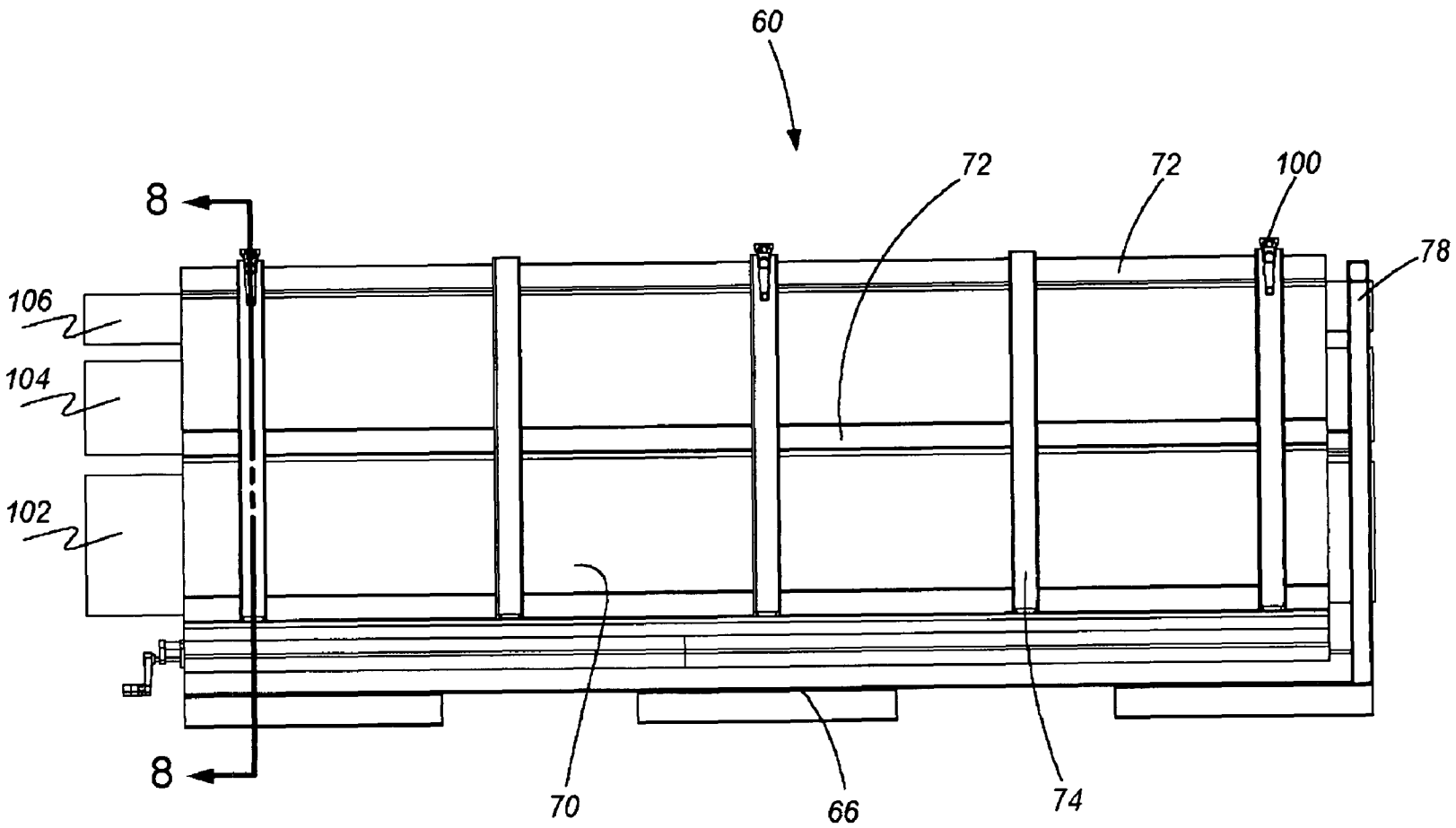
FIG. 7 is a side elevational view of the mold.

Turning to FIGS. 5 and 6, a mold is shown therein and indicated generally by the numeral 60. Mold 60 is designed to cast the landscaping blocks that comprise the set of blocks 10. As will be appreciated from subsequent portions of this disclosure, a selected concrete mix is poured into the mold 60 and after a certain period of time the concrete mix forms a plurality of landscaping blocks according to the present invention.

Now viewing the mold 60 in more detail, the mold 60 includes an elongated bottom 62. Bottom 62 can be constructed of various materials, but in the case of one embodiment, bottom 62 would comprise a metal plate. Bottom 62 is supported by a pair of opposed rails 64 and 66. Note that in the case of the design illustrated herein, that each rail includes an upper rail and a lower rail. The lower rails include selected openings that form areas where the forks of a forklift can be inserted under the mold 60. This enables the mold 60 to be conveniently transported from one location to another with a forklift or other type of lifting and transporting device. Further, the bottom structure of the mold includes a series of spaced apart transverse channels 68 that extend between the two rails 64 and 66.

Mold 60 includes a pair of sides with each side being pivotally mounted to the bottom structure of the mold. Each side is movable from an open position shown in FIG. 5 to a closed position shown in FIG. 6. In the embodiment illustrated herein, each side is pivotally mounted to a lower portion of the mold 60. Various types of hinge structures can be utilized to secure the sides to the lower portion of the mold 60. In the case of the embodiment illustrated herein, it is contemplated that a piano type hinge could be provided.

Each side includes a sidewall 70. Sidewall 70 is reinforced by a series of longitudinal channel members 72 that are secured to the exterior of the wall 70. Further reinforcement is provided by a plurality of exterior transverse channel members 74. As seen in the drawings, transverse channel members 74 extend exteriorly of the longitudinal channel members 82.

Also secured to the inside face of each sidewall 70 is an inside retainer 76. Inside retainer 76 is in the form of a piece of angle iron that includes a flange that projects into the mold, about the leftmost side of the mold as viewed in FIGS. 5 and 6, when the sides assume a closed position. As will be appreciated from subsequent portions of this disclosure, the inside retainers 76 serve to reinforce an end portion of the mold.

Disposed on one end of the mold is a bulkhead 78. Bulkhead 78, which is disposed on the rightmost end of the mold as viewed in FIGS. 5 and 6, functions to reinforce the mold 60 and particularly to reinforce the mold with respect to the loads created by the liquefied concrete mix that is held in the mold subsequent to pouring.

Supported on the bottom portion of the mold 60 is a series of laterally spaced plates 80. The plurality of plates 80 forms a series of sections, each section being defined between two consecutive plates 80 and indicated generally by the numeral 82. As will be appreciated from subsequent portions of the disclosure, each section 82 forms one landscaping block. The spacings between the respective plates 80 can be uniform throughout the mold 60. However, as discussed above, some sets of landscaping blocks 10 may include blocks of varying thicknesses. Accordingly, some of the plates 80 could be spaced to yield 3" blocks, 4½" blocks, 6" blocks, or any other desirable height.

Individual plates 80 are constructed of metal and include a vertical section and a lower flange portion or base 80A that is turned at an angle of approximately 90° with respect to the vertical section. Further, each plate includes one or more openings. In the embodiment illustrated herein, the plates 80 include three openings. However, it is appreciated that the plates 80 could be designed to have two openings, one opening, or in some cases, no openings. It follows that by including three openings in the respective plates 80, that the mold 60 shown in the drawings would produce landscaping blocks having three openings therein.

Figure 8:
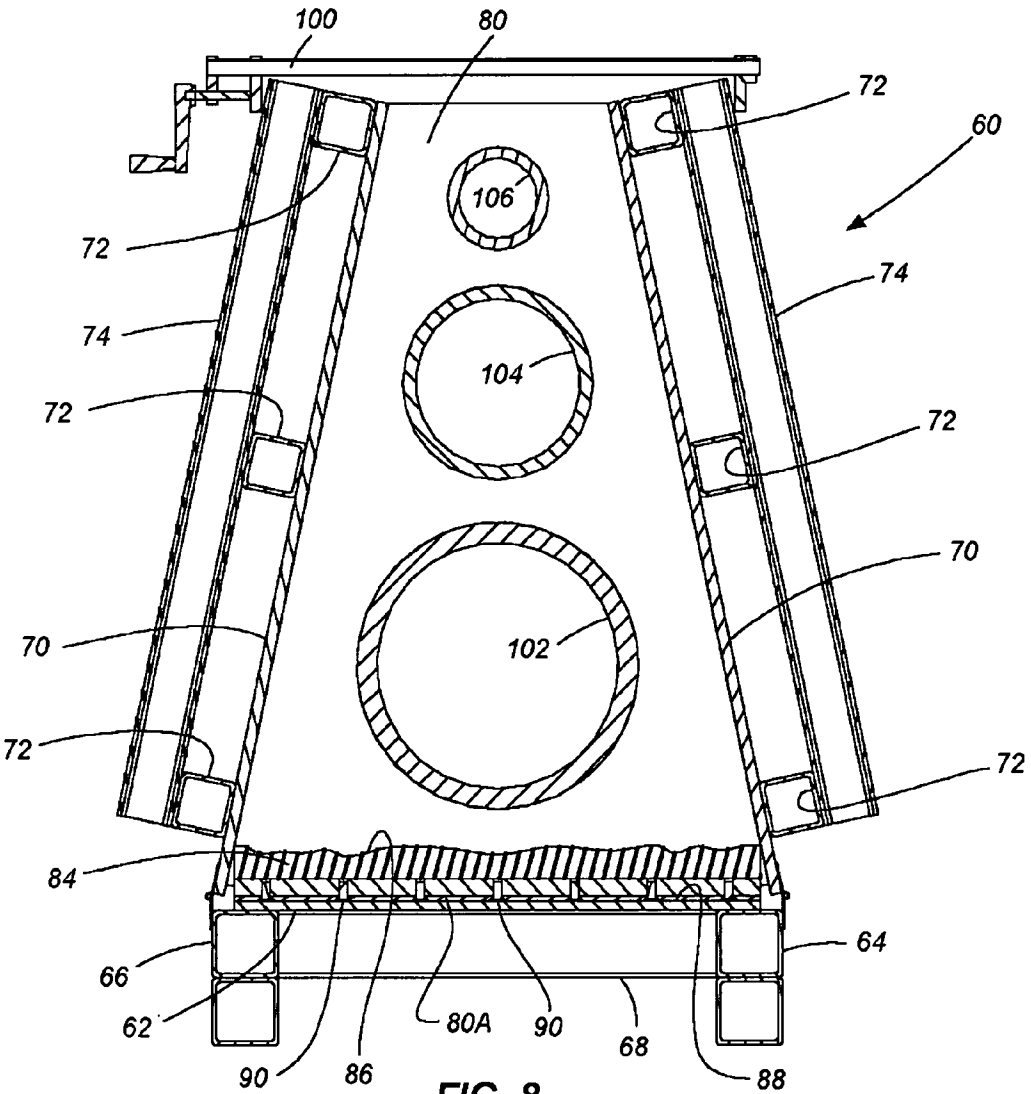
FIG. 8 is a sectional view taken through the line 8-8 of FIG. 7.

Returning to the bottom structure of the mold, the bottom is formed in part from the lower portions 80A of the plates 80 and other structures. More particularly, the bottom portion 80A of each plate form an angled base that extends from the vertical portion of each plate at an angle of approximately 90°. Disposed over each base 80A is a urethane block 84 having a molded face 86. The urethane block 84 is particularly molded, in one embodiment, such that its face 86 simulates the appearance of natural stone. In addition, urethane block 84 is molded around a base 88, which could comprise a strip of plywood. Note that in the case of each of the defined sections 82, that the molded block 84 and the base 88 would overly the base portion 80A of a respective plate 80. Viewing FIG. 8, the bottom structure of the mold 60 is clearly illustrated. The bottom structure includes the two rails 64 and 66, and the series of transverse cross members 68. Secured over the cross members 68 is the bottom 62 of the mold. Disposed over the bottom 62 are the series of bases 80A that form a part of the respective plates 80. Then, disposed over each base 80A in each section 82 is the urethane block that includes the base or plywood strip 88. To secure these components in place, a series of screws 90 are screwed upwardly, through the bases 80A and into the urethane blocks 84 including the base or plywood strips 88 associated therewith. Thus, it is appreciated that each plate 80 has associated therewith a urethane block 84 including a base or plywood strip 88. Thus, the mold 40 includes a series of panel subassemblies where each panel subassembly comprises the plate 80 including its base 80A and the urethane block 84 including its base or plywood strip 88. These panel subassemblies are not secured to the bottom 62 of the mold. That is, these panel assemblies can be removed from the mold 60. In addition, these panel assemblies comprising the respective plates 80, urethane blocks 84 and associated bases or plywood strips 88 can be moved laterally back and forth over the bottom 62. In use, these panels or subassemblies can be compressed together such that the urethane blocks 84 form a generally sealed relationship about the bottom of the respective sections 82.

As noted above, each of the sides is pivotally mounted to the bottom structure of the mold 60. Each side is movable between an open position, shown in FIG. 5, and a closed position shown in FIG. 6. In the closed position, the sides must be fastened in place. That is, the inner side of the sidewalls 70 abut adjacent the outer edges of the respective plates 80 to form the generally sealed sections 82. It follows that the mold 60 is provided with one or more fasteners for securing the sides in the closed position. Many different types of fasteners can be utilized. In the present case, a series of screw type clamp assemblies 100 are provided across the top portions of the mold in spaced apart relationship. It is appreciated, as shown in FIG. 6, that when the sidewalls 70 assume the closed position and are fastened by the clamp assemblies 100, that the upper portion of the mold 60 is open. That is, the upper portions of the respective sections 82 are open. This allows concrete to be poured from the top into the respective sections 82.

Mold 60 also includes one or more elongated member for extending through aligned openings of the respective plates 80. In the case of the embodiment shown in FIGS. 5-8, the respective plates each include three openings of various sizes. Accordingly, the mold 60 is provided with three matching elongated members. In the case of the design of FIGS. 5-8, these elongated members assume the form of three PVC pipes 102, 104 and 106. These pipes are inserted into the mold prior to pouring.

Mold 60 illustrated in the drawings is designed to form one of the groups of blocks that form the landscaping block set 10. It is appreciated that different side molds would be utilized to form blocks of various depths and sizes and with a varying number of openings formed therein. That is, there would be provided one mold, for example, for the landscaping block that includes a single opening and another mold for molding the landscaping block having a pair of openings.

It is appreciated that the respective sections 82 that are formed in the mold 60 should be generally sealed to prevent the concrete, after pouring, from leaking from the sections or the mold. Consequently, the clamp assemblies 100 function to pull the sides 70 tightly against the outer edges of the plates 80 so as to form a generally sealed relationship between the interior surface of the wall 70 and the outer edges of the plates 80. In addition, it is appreciated that the inside retainers 76 formed on the inside of the walls 70 function to add stability to the mold 60. That is, when the doors 70 assume closed positions, the retainers 76 will generally lie adjacent the outer side of the leftmost plate 80, as viewed in FIGS. 5 and 6. Thus, the leftmost plate 80 will generally engage or abut against the retainers 76 such that the retainers will maintain that leftmost plate 80 upright when concrete is poured into the adjacent section 82 of the mold. Note in FIGS. 5-7 where the mold 60 is provided with a small hand crank about the lower leftmost end of the mold. The purpose of this hand crank is to generally tighten up the respective sections 82 of the mold. More particularly, the function of the hand crank is to tighten the individual panel assemblies together. As noted before, the respective plates 80 and their associated urethane blocks 84 can be moved along the bottom 62 of the mold. The hand crank is functional to tighten or compress these assemblies together before pouring. Prior to utilizing the mold, the mold 60 is sprayed with oil in order to facilitate the removal of the pipes 102, 104, 106 and to facilitate the removal of the respective precast landscaping blocks once the blocks have been cured. The concrete utilized could be self-compacting concrete and could be colored any number of tones. In some cases, the concrete would be colored to simulate natural stone. In any event, after pouring the concrete into the top of mold 60 and filling respective sections 82, the concrete is allowed to set and cure. Before the concrete completely hardens, the respective pipes 102, 104 and 106 are removed from the mold. Essentially the concrete should harden sufficient enough that the shape of the openings is retained when the pipes are extracted from the mold. The total time required for the landscaping blocks to cure and harden will vary depending on environmental conditions, the size of the landscaping blocks being molded, and other factors. Generally, the concrete will usually set at least five hours before the respective blocks can be pulled from the mold.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A landscaping block set for forming retaining walls comprising:

a. a first group of precast landscaping blocks;

b. a second group of precast landscaping blocks;

c. a third group of precast landscaping blocks;

d. each block of each group assumes a generally trapezoidal shape and includes a molded face, back, two straight and tapered sides that extend from the face to the back, upper surface, lower surface, a width, height, and a depth;

e. wherein the depth of the blocks of the first group exceed the depth of the blocks of the second group;

f. wherein the depth of the blocks of the second group exceed the depth of the blocks of the third group;

g. wherein the first, second and third groups of precast blocks form a retaining wall with the first group of blocks forming one or more lower courses of the retaining wall, the second group of blocks forming one or more intermediate courses of the retaining wall, and the third group of blocks forming one or more upper courses of the retaining wall; and h. wherein the first, second and third groups of blocks are stacked so as to form a step configuration about a backside of the retaining wall.

2. The landscaping block set of claim 1 wherein each block of the groups includes one or more openings that extend from the upper surface to the lower surface.

3. The landscaping block set of claim 2 wherein the openings formed in the blocks are round.

4. The landscaping block set of claim 2 wherein the sides of the respective blocks are straight but non-parallel.

5. The landscaping block set of claim 1 wherein the blocks of each group include faces having at least two different widths.

6. The landscaping block set of claim 1 wherein each block of each group is of a tapered configuration as the width of the blocks become progressively narrow from the face to the back.

7. The landscaping block set of claim 1 wherein each block is in the form of precast concrete and wherein the face of each block is molded to simulate stone.

8. A retaining wall comprised of a landscaping block set, comprising:

a. one or more lower courses of precast landscaping blocks;

b. one or more intermediate courses of precast landscaping blocks disposed over the one or more lower courses of blocks;

c. one or more upper courses of precast landscaping blocks disposed over the one or more intermediate courses of precast landscaping blocks;

d. wherein the one or more lower courses of precast landscaping blocks comprises a first group of blocks, e. wherein the one or more intermediate courses of blocks comprises a second group of landscaping blocks;

f. wherein the one or more upper courses of blocks comprises a third group of landscaping blocks;

g. wherein each block includes a molded face, back, two sides, upper surface, lower surface, a width, height and a depth;

h. wherein the depth of the blocks of the first group exceed the depth of the blocks of the second group;

i. wherein the depth of the blocks of the second group exceed the depth of the blocks of the third group;

j. wherein each block of the first, second and third groups assume a generally trapezoidal shape, and wherein each of the sides of the block tapers from the face to the back and is substantially straight along the taper from the face to the back; and k. wherein the first, second and third groups are stacked such that a backside of the retaining wall is formed and wherein the backside assumes a step configuration and wherein the depth of the retaining wall increases from the one or more lower courses to the one or more upper courses.

9. The retaining wall of claim 8 wherein each block of the groups includes one or more openings that extend from the upper surface to the lower surface.

10. The retaining wall of claim 9 wherein the blocks of the third group include at least one opening, the blocks of the second group including at least two openings, and the blocks of the first group including at least three openings.

11. The retaining wall of claim 10 wherein the blocks of the first and second groups are elongated and wherein the openings therein are longitudinally aligned.

12. The retaining wall of claim 9 wherein the openings formed in the blocks are round.

13. The retaining wall of claim 9 wherein the sides are straight but extend in a non-parallel relationship.

14. The retaining wall of claim 8 wherein the blocks of each group include faces having a least two different widths.

15. The retaining wall of claim 8 wherein each block of each group is of a tapered configuration as the width of the blocks become narrower from the face to the back.

16. The retaining wall of claim 8 wherein each block is in the form of precast concrete and wherein the face of each block is molded to simulate stone.

17. A method of forming a retaining wall from a set of precast landscaping blocks, comprising:

a. selecting from the set of blocks a first group of landscaping blocks having a depth and utilizing the first group of blocks to form one or more lower courses of the retaining wall;

b. selecting from the set a second group of landscaping blocks having a depth less than the depth of the first group of blocks, and forming one or more intermediate courses of the retaining wall with the second group of blocks, and wherein the second group of blocks are stacked over the first group of blocks such that at least a portion of the upper surfaces of some of the first group of blocks are left exposed;

c. selecting from the set a third group of landscaping blocks having a depth less than the depth of the second group of blocks, and forming one or more upper courses of the retaining wall with the third group of blocks by stacking the third group of blocks over the second group of blocks such that at least a portion of the upper surfaces of some of the second group of blocks remain exposed; and d. wherein selecting the first, second and third groups of blocks includes selecting blocks where each block has an upper surface, lower surface, a width, height and a depth, and wherein each block assumes a generally trapezoidal shape and includes a molded face, back, two tapering sides that extend from the face to the back and wherein the two tapering sides are substantially straight from the face to the back.

18. The method of forming the retaining wall of claim 17 wherein the backs and a portion of the upper surfaces of the respective blocks form a step configuration about a backside of the retaining wall.

19. The method of forming the retaining wall of claim 17 including forming the respective blocks of each group by precasting concrete.

20. The method of forming the retaining wall of claim 19 including molding the faces of the respective blocks to simulate a stone appearance.

21. The method of claim 17 including forming each block of each group into a generally trapezoidal shape.

22. The method of forming a retaining wall of claim 21 further including forming one or more openings in each block such that the openings extend from an upper surface to a lower surface of the respective blocks.

23. The method of forming a retaining wall of claim 22 including forming at least three openings in the first group of blocks, at least two openings in the second group of blocks, and at least one opening in the third group of blocks.

24. The method of claim 17 wherein the groups of blocks are freestanding and are not structurally tied or connected to any adjacent structure or ground area.

25. The method of claim 17 including forming the blocks of the three groups by pouring concrete into one or more multi-sectional molds, each having one or more removable pipes extending through the sections of the mold, wherein the pipe forms the one or more openings in each of the blocks.

26. The method for forming a retaining wall of claim 25 including placing a simulated stone molding surface in a bottom portion of each section of the one or more molds and pouring concrete into each section of the mold where the simulated stone molding surface forms a simulated stone appearance across the face of the respective blocks being cast in the mold.

27. A landscaping block set for forming retaining walls, comprising:

a. a first group of precast landscaping blocks;

b. a second group of precast landscaping blocks;

c. each block of each group assuming a generally trapezoidal shape and including a molded face, back, two tapering sides that extend from the face to the back and which are substantially straight from the face to the back, upper surface, lower surface, a width, height and a depth;

d. wherein the depth of the blocks of the first group exceed the depth of the blocks of the second group;

e. wherein the first and second group of precast blocks are adapted to form a retaining wall with the first group of blocks forming one or more lower courses of the retaining wall and the second group of blocks forming one or more courses over the first group of retaining blocks; and f. wherein the first and second groups of blocks are adapted to be stacked to form a step configuration about a backside of the retaining wall.

28. The landscaping block set of claim 27 wherein each block of the groups assume a generally trapezoidal shape.

29. The landscaping block set of claim 28 wherein certain blocks of the groups include one or more openings that extend from the upper surface to the lower surface.

30. The landscaping block set of claim 29 wherein the blocks of the first group include at least two openings and the blocks of the second group include at least one opening.

31. The landscaping block set of claim 27 wherein at least some of the precast blocks are elongated and include a tapered configuration.

32. The landscaping block set of claim 27 wherein at least one group of the blocks assumes a tapered configuration with the width of the blocks becoming progressively narrow from the face to the back.

33. The landscaping block set of claim 27 wherein the block set includes at least a third group of blocks and wherein the depth of the second group of blocks exceeds the depth of the third group of blocks.

34. The landscaping block set of claim 27 wherein the first and second groups taper inwardly from the face to the back of the respective blocks.

* * * * *